United States Patent [19]

Arai

[11] Patent Number: 4,566,363

[45] Date of Patent: Jan. 28, 1986

[54] ELECTRONIC MUSICAL INSTRUMENT

[75] Inventor: Yoneaki Arai, Chichibu, Japan

[73] Assignee: Casio Computer Co., Ltd., Tokyo, Japan

[21] Appl. No.: 583,121

[22] Filed: Feb. 24, 1984

[30] Foreign Application Priority Data

Mar. 2, 1983 [JP] Japan ..... 58-28908[U]
Dec. 27, 1983 [JP] Japan ..... 58-246814

[51] Int. Cl.[4] ..... G10H 1/34; G10H 1/46

[52] U.S. Cl. ..... 84/1.08; 84/1.27; 84/DIG. 14

[58] Field of Search ..... 84/1.04, 1.06–1.14, 84/376 R, 376 EA, DIG. 14, DIG. 15, 1.27

[56] References Cited

U.S. PATENT DOCUMENTS

| | | | |
|---|---|---|---|
| 2,455,032 | 11/1948 | Williams | 84/DIG. 14 |
| 2,745,307 | 5/1956 | Elsasser | 84/377 |
| 3,322,875 | 5/1967 | Roll et al. | 84/1.14 |
| 4,252,045 | 2/1981 | Nagura | 84/1.14 |
| 4,385,541 | 5/1983 | Müller et al. | 84/1.14 |

FOREIGN PATENT DOCUMENTS

| | | |
|---|---|---|
| 3201828 | 10/1982 | Fed. Rep. of Germany . |
| 1150965 | 5/1969 | United Kingdom . |
| 1200823 | 8/1970 | United Kingdom . |
| 1303987 | 1/1973 | United Kingdom . |
| 2064873 | 6/1981 | United Kingdom . |

*Primary Examiner*—S. J. Witkowski
*Attorney, Agent, or Firm*—Frishauf, Holtz, Goodman & Woodward

[57] ABSTRACT

A through hole is formed in the top wall of an inhalation hole which communicates with the outside by means of an elongate channel. The through hole is closed by an elastic member having a bulging portion. A projection is formed in the center of the bulging portion, and retains the extreme end of a movable contact of a contact mechanism. A fixed contact is fixed on a circuit board. When the bulging portion is depressed downward by inhalation, the movable contact is brought into touch with the fixed contact to produce an input signal.

13 Claims, 13 Drawing Figures

FIG. 3
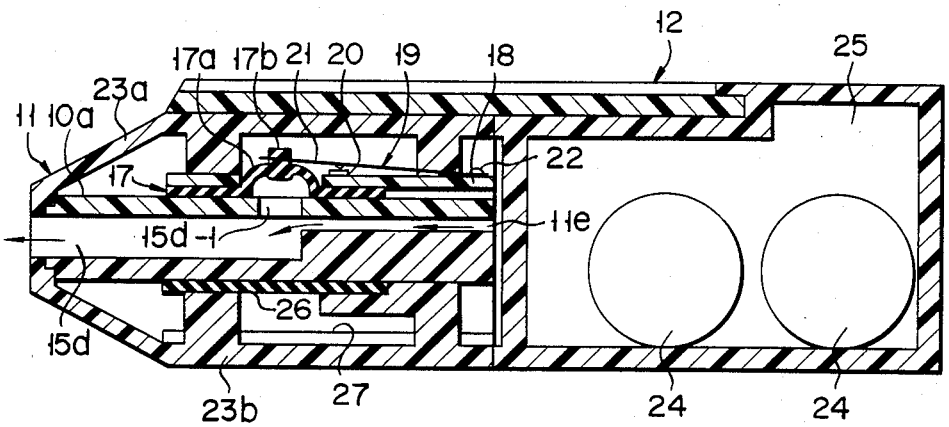
FIG. 4
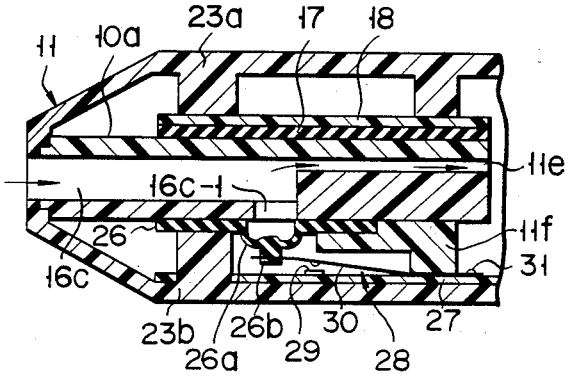
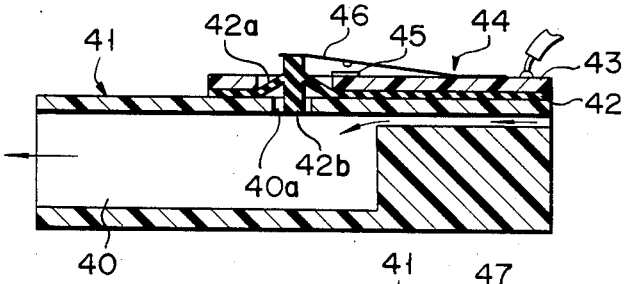
FIG. 5A
FIG. 5B
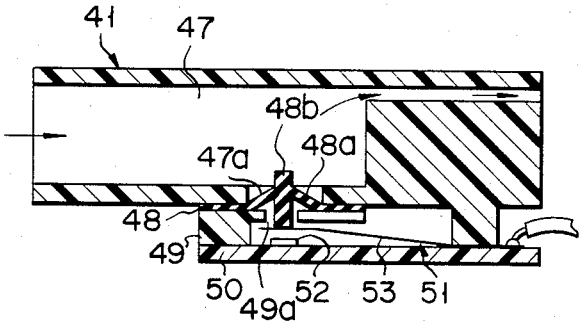

FIG. 8
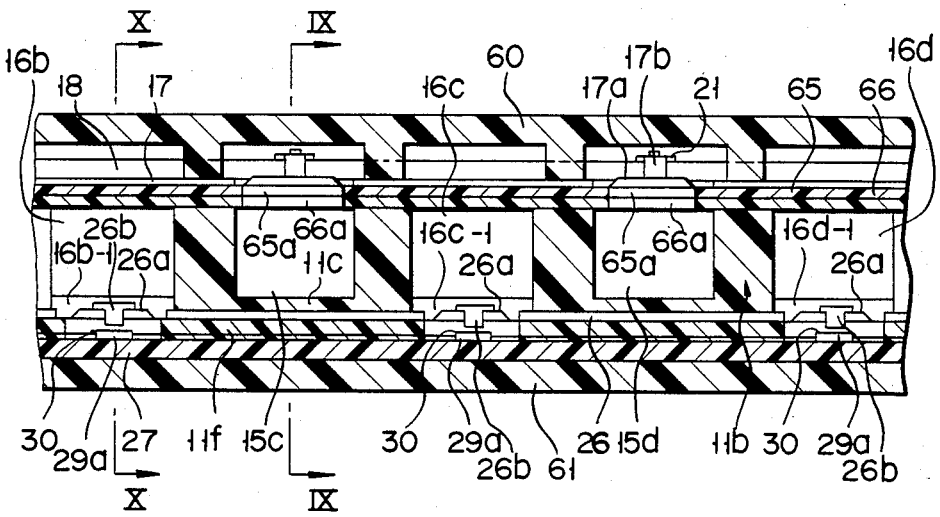
FIG. 9
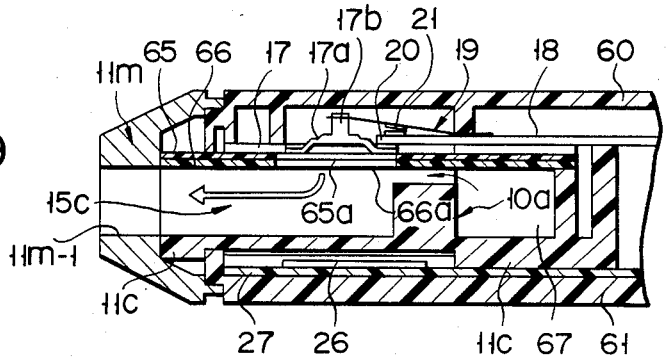
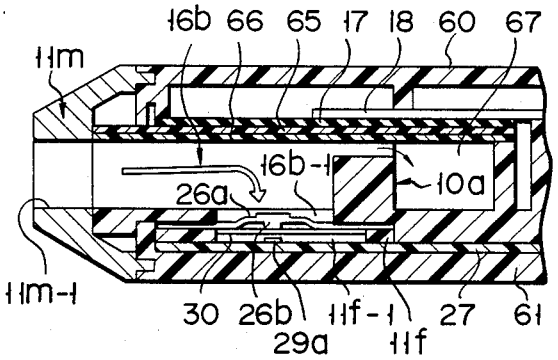
FIG. 10

ELECTRONIC MUSICAL INSTRUMENT

BACKGROUND OF THE INVENTION

The present invention relates to an electronic musical instrument, such as an electronic harmonica, having an input device driven by the flow of a breath.

Conventionally, an electronic harmonica is connected to external amplifiers, a power source, etc., by means of connecting cords extending from the harmonica housing so that musical sounds are produced from external loudspeakers. Although the harmonica housing may be compact in design, the use of the amplifiers, power source, loudspeakers and other external equipments lessens the portability of the instrument, constituting a hindrance to an easy musical performance.

An input device in the harmonica housing is provided with a contact mechanism which is driven by exhalation or inhalation. Since an electric circuit section including the contacts of the contact mechanism are subjected directly to the exhalation, the section is deteriorated in durability and is liable to contact failure. Various methods are proposed for driving the contact mechanism by breathing without causing the breath directly to touch the contacts. In any of these methods, however, the on-off operation of the contacts requires strong flows of breath, lowering the operating efficiency of the harmonica.

SUMMARY OF THE INVENTION

An object of the present invention is to provide an electronic musical instrument maintaining compactness and portability, enjoying operating efficiency equal to that of a conventional harmonica, and capable of expressive musical performance.

Another object of the invention is to provide an electronic musical instrument of a harmonica type, simple in construction, capable of low-cost manufacture with high mass production efficiency, and high in operating efficiency as well as in reliability and durability.

According to the invention, there is provided an electronic musical instrument which comprises a case, a plurality of sound holes arranged in the case, openings formed individually in the walls of the sound holes, elastic members of an elastic material closing the openings and adapted to be deformed in accordance with the change of the pressure inside the sound holes caused by exhalation or inhalation, contact mechanisms disposed outside the sound holes and having contacts operatively coupled to the elastic members and adapted to be driven in accordance with the deformation of the elastic members, input signal generating means connected to the contact mechanisms and generating input signals in accordance with the drive of the contacts, musical sound producing means contained in the case and producing musical sounds in accordance with the input signals, and a power source in the case.

BRIEF DESCRIPTION OF THE DRAWING

FIG. 3 is an enlarged sectional view taken along line III—III of FIG. 1;

FIG. 4 is an enlarged sectional view of an exhalation sound hole shown in FIG. 1;

FIGS. 5A and 5B are sectional views of sound holes of an electronic musical instrument according to another embodiment of the invention;

FIG. 8 is an enlarged sectional view taken along line VIII—VIII of FIG. 6;

FIGS. 9 and 10 are sectional views taken along lines IX—IX and X—X of FIG. 8, respectively.

DETAILED DESCRIPTION OF THE PREFERRED EMBODIMENTS

Figure 1:
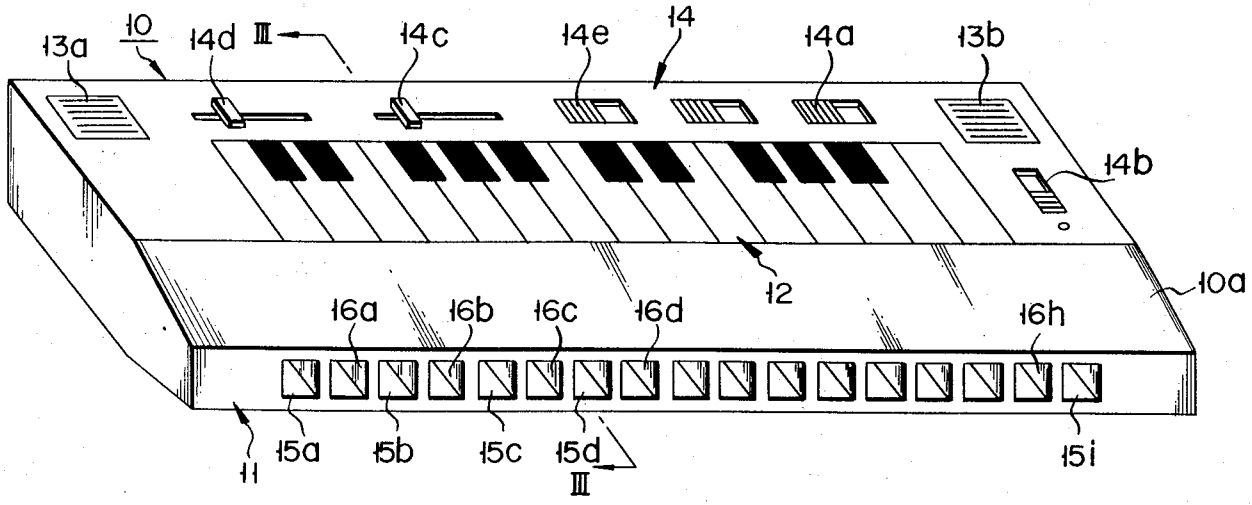
FIG. 1 is a perspective view showing an outline of an electronic musical instrument according to one embodiment of the present invention.

A case 10 of an electronic harmonica shown in FIG. 1 is provided with a sound hole section 11, a manual section 12 formed of touch keys, loudspeaker sections 13*a* and 13*b*, and a control switch section 14. The sound hole section 11 includes a plurality of inhalation sound holes 15*a*, 15*b*, . . . and 15*i* and a plurality of exhalation sound holes 16*a*, 16*b*, . . . and 16*h* that are alternately arranged in a straight line. The manual section 12 is formed of white and black touch keys for approximate two octaves. The control switch section 14 includes a mode selector switch 14*a* for shifting between a mouth mode in which the electronic musical instrument is used as a harmonica and a key input mode in which the instrument serves as a keyed instrument, a power switch 14*b*, a volume control lever 14*c*, a tone selector lever 14*d*, a chord designating switch 14*e*, etc. The case 10 shown in FIG. 1 contains therein an electric circuit section which produces musical sound signals in accordance with input signals from a switch mechanism in the sound hole section 11 or from the touch keys in the manual section 12, and a power source for energizing the electric circuit section.

Figure 2:
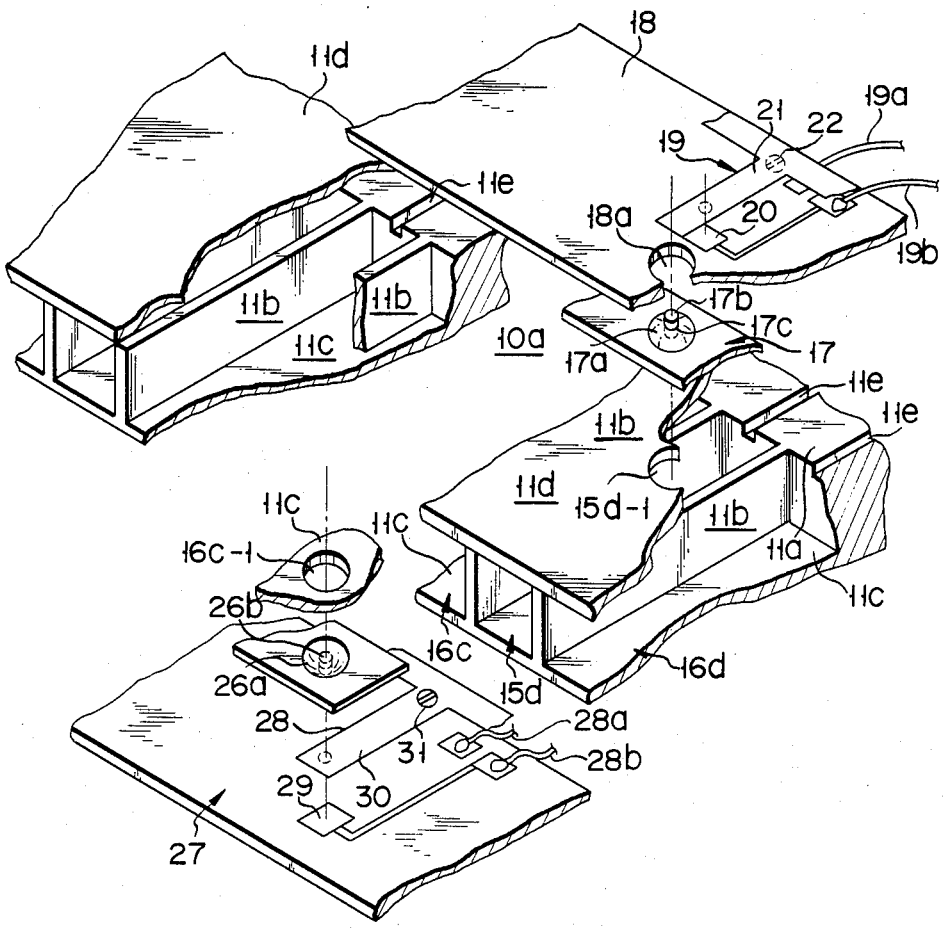
FIG. 2 is a disassembled perspective view showing a part of the instrument of FIG. 1.

Referring now to FIGS. 2 to 4, the construction of the sound hole section 11 will be described. In FIG. 2, the sound hole section 11 comprises a frame 11*a*, a plurality of partition walls 11*b* extending in one direction from the frame 11*a*, a bottom plate 11*c* covering the lower ends of the partition walls 11*b*, and a top plate 11*d* overlying rectangular-prism-shaped spaces that are each defined by two adjacent partition walls 11*b* and the bottom plate 11*c*. Thus, the alternately arranged inhalation and exhalation sound holes are formed. The top plate 11*d* has through holes or openings, such as an opening 15*d*-1 which communicates with the sound hole 15*d*. The opening 15*d*-1 is hermetically sealed by a bulging portion 17*a* which protrudes upward from a rubber plate 17 on the top plate 11*d*. An upward projection 17*b* is formed on the central part of the bulging portion 17*a*. The projection 17*b* has a cut 17*c*.

A printed circuit board 18 is placed on the top plate 11*d*, sandwiching the rubber plate 17 therebetween. A through hole or opening 18*a* is formed in that portion of the printed board 18 which corresponds to the bulging portion 17*a*. The bulging portion 17*a* and the projection 17*b* project above the printed circuit board 18 through the opening 18*a*. A contact mechanism 19 formed of a fixed contact 20 and a movable contact 21 is provided on the printed circuit board 18. One end of the movable contact 21 is fixed on the printed circuit board 18 by means of a screw 22, while the other end is inserted in the cut 17*c* of the projection 17*b*. When the bulging portion 17*a* is in its stop position, the movable contact 21 is off the fixed contact 20. The frame 11*a* has an elongate channel 11*e* which communicates with the inhalation sound hole 15*d*. The other inhalation sound holes 15*a* to 15*c* and 15*e* to 15*i* are formed in the same manner.

For example, an opening 16*c*-1 communicating with the exhalation sound hole 16*c* is formed in that portion of the bottom plate 11*c* which defines the sound hole 16*c*. The opening 16*c*-1 is hermetically sealed by a bulging portion 26*a* which protrudes downward from a rubber plate 26 put on the underside of the bottom plate 11*c*. A downward projection 26*b* having a cut 26*c* is formed in the center of the bulging portion 26*a*.

A printed circuit board 27 is provided under the rubber plate 26 with a spacer 11*f* between them. A contact mechanism 28 formed of a fixed contact 29 and a movable contact 30 is provided on that portion of the printed circuit board 27 which corresponds to the bulging portion 26*a*. One end of the movable contact 30 is fixed on the printed circuit board 27, while the other end is inserted in the cut 26*c* of the projection 26*b*. In the state of FIG. 4 wherein the bulging portion 26*a* is not deformed by any external force, the movable contact 30 is off the fixed contact 29. The other exhalation sound holes 16*a*, 16*b* and 16*d* to 16*h* are constructed in the same manner.

The contact mechanisms 19 and 28 are connected to the circuit for producing tone signals in the case 10 by means of lead wires 19*a*, 19*b*, 28*a* and 28*b*.

The whole harmonica housing 10*a* shown in FIG. 2 is covered with an upper cover 23*a* and a lower cover 23*b*, as shown in FIGS. 3 and 4. Batteries 24 as a power source and a case 25 containing musical sound producing circuit elements are integrally attached to the rear portion of the harmonica housing 10*a*. Thus, an electronic harmonica is completed.

The operation of the electronic musical instrument constructed in this manner will now be described. When using the instrument as a harmonica, the power switch 14*b* of FIG. 1 is turned on, and the mode selector switch 14*a* is shifted to the mouth mode side. The volume control lever 14*c* is set to a suitable position, and a desired tone is selected by means of the tone selector lever 14*d*. In this state, the sound hole section 11 is held against the mouth of a player, and air is inhaled through, e.g., the inhalation hole 15*d* corresponding to a desired note. Thereupon, the air pressure inside the inhalation hole 15*d* is lowered, so that the bulging portion 17*a* of the rubber member 17 is elastically deformed or depressed downward. As a result, the movable contact 21 of the contact mechanism 19 is pulled down by the projection 17*b* of the bulging portion 17*a* to be brought into touch with the fixed contact 20 on the printed circuit board 18. Then, a contact signal is delivered from the contact mechanism 19, and is produced as a musical sound of a note corresponding to the inhalation hole 15*d* from the loudspeaker sections 13*a* and 13*b* through a predetermined circuit.

If a breath is given out into, e.g., the exhalation hole 16*c*, the air pressure inside the exhalation hole 16*c* is increased, so that the bulging portion 26*a* of the rubber member 26 is elastically deformed or swollen, thereby depressing the projection 26*b*. As a result, the movable contact 30 of the contact mechanism 28 is pressed down and brought into touch with the fixed contact 29 on the printed circuit board 27. Thereupon, a contact signal is delivered from the contact mechanism 28, and is produced as a musical sound from the loudspeaker sections 13*a* and 13*b* through the predetermined circuit in the same manner as aforesaid.

Thus, according to the electronic harmonica described above, the harmonica housing 10*a* with the alternately arranged inhalation and exhalation holes is provided with the rubber members 17 and 26 having the bulging portions 17*a* and 26*a* which are elastically deformed in accordance with the change of the air pressure inside to sound holes, thereby driving the contact mechanisms 19 and 28. Therefore, the electronic harmonica of this embodiment is simple in construction, easy to assemble, and can be manufactured at low cost with high mass production efficiency. Moreover, this instrument is high in operating reliability and durability. The contact mechanisms 19 and 28 are driven by means of the bulging portions 17*a* and 26*a* of the rubber members 17 and 26 that are elastically deformed in accordance with the change of the internal air pressure of the inhalation and exhalation holes. It is therefore unnecessary to adjust the load of the contact mechanisms 19 and 28, and the manufacture of the instrument is facilitated. Since the inhalation and exhalation holes whose internal air pressures are changed by breathing can completely be isolated from the electric system including the printed circuit boards 18 and 27 and the contact mechanisms 19 and 28 by means of the rubber members 17 and 26, the electric system can operate reliably without being moistened by breathing.

In the above embodiment, the sound hole section 11 and the manual section 12 are prevented from simultaneously sounding by adjusting the switch section 14 to the mouth mode. Alternatively, however, the sound hole section 11 and the manual section 12 may be constructed so that they can simultaneously deliver their respective signals or musical sounds. Thus, a duet may be enjoyed on a single electronic harmonica in a manner such that, for example, the sound hole section 11 is operated for a melody and the manual section 12 for an accompaniment.

In the above embodiment, moreover, the inhalation holes 15*a* to 15*i* and the exhalation holes 16*a* to 16*h* are alternately arranged in a line. These sound holes may, however, be arranged in two or more rows, or may be replaced with a single inhalation or exhalation hole, such as a mouthpiece. The signals delivered from the holes are not limited to the note designating signals for natural notes, and may be signals for derivative notes or mere contact signals.

Referring now to FIGS. 5A and 5B, another embodiment of the invention will be described. FIGS. 5A and 5B show the inhalation and exhalation sides of a harmonica, respectively.

An inhalation hole 40 shown in FIG. 5A, like the ones used in the first embodiment, is a rectangular-prism-shaped hole formed in a harmonica housing 41. An opening 40*a* is formed in the inner upper portion of the hole 40. A rubber member 42 hermetically sealing the opening 40*a* is provided on the harmonica housing 41. The rubber member 42 is provided with an umbrella-shaped bulging portion 42*a* which projects upward from the position corresponding to the opening 40*a*. A projetion 42*b* projecting both upward and downward is formed in the center of the bulging portion 42*a*. A printed circuit board 43 is placed on the rubber member 42 except that portion thereof which corresponds to the bulging portion 42*a*. A contact mechanism 44 formed of a fixed contact 45 and a movable contact 46 is mounted on the printed circuit board 43. The extreme end of the movable contact 46 of the contact mechanism 44 is bonded to the upper end of the projection 42*b* of the bulging portion 42*a*. When the bulging portion 42*a* of the rubber member 42 is elastically deformed or depressed by the reduction of the air pressure inside the inhalation hole 40 caused by inhalation, the movable contact 46 is pulled down by the projection 42*b* of the bulging portion 42*a*, and comes into touch with the fixed contact 45, thereby delivering a contact signal.

An exhalation hole 47 shown in FIG. 5B is a rectangular-prism-shaped hole formed in the harmonica housing 41. A relatively wide opening 47*a* is formed in the inner lower portion of the hole 47. A rubber member 48 with quite the same construction as the rubber member 42 is provided on the underside of the harmonica housing 41. In this case, a bulging portion 48*a* formed on the rubber member 48 is located in the opening 47*a*. A printed circuit board 50 is disposed under the rubber member 48 with a spacer 49 between them. A through hole 49*a* is formed in that portion of the spacer 49 which corresponds to the bulging portion 48*a*. The lower end of a projection 48*b* formed on the bulging portion 48*a* projects downward through the through hole 49*a*. A contact mechanism 51 formed of a fixed contact 52 and a movable contact 53 is mounted on the printed circuit board 50 in the same manner as aforesaid. In this case, one end portion (right end portion in FIG. 5B) of the movable contact 53 is fixed on the printed circuit board 50, while the other end portion (left end portion) is attached to the lower end of the projection 48*b* of the bulging portion 48*a*. Thus, when the bulging portion 48*a* of the rubber member 48 is elastically deformed or depressed by the air pressure inside the exhalation hole 47 which is increased by exhalation, the movable contact 53 of the contact mechanism 51 is pressed down by the projection 48*b* of the bulging portion 48*a*, and comes into touch with the fixed contact 52, thereby delivering a contact signal.

In the input device of the above described construction, which shares the function and effect with the first embodiment, the number of components is reduced to facilitate manufacture and assembly, since the rubber members 42 and 48 for the inhalation and exhalation holes 40 and 47 have quite the same construction.

The electronic musical instrument according to the present invention, as described above, is high in portability, since all of its components can be completely housed in the case 10. Moreover, the opening communicating with the outside is formed in a sound hole whose internal air pressure is changed by breathing, and an elastic member is used to hermetically seal the opening. The elastic member is elastically deformed by the change of the air pressure inside the sound hole caused by breathing, thereby bringing a movable contact of a contact mechanism into touch with a fixed contact. Thereupon, a contact signal is delivered from the contact mechanism. Thus, there may be provided an electronic musical instrument which is simple in construction, and can be manufactured at low cost with high mass production efficiency. Also, the instrument is high in operating reliability and durability. The contact mechanism is driven by the elastic member which is elastically deformed in accordance with the change of the internal air pressure of the sound hole. It is therefore unnecessary to adjust the load of the contact mechanism, and the manufacture of the instrument is facilitated. Since the interior of the sound hole whose internal air pressure is changed by breathing is completely isolated from the electric system including the contact mechanism by means of the elastic member, the electric system can reliably operate without being moistened by breathing, and can be improved in durability.

Figure 6:
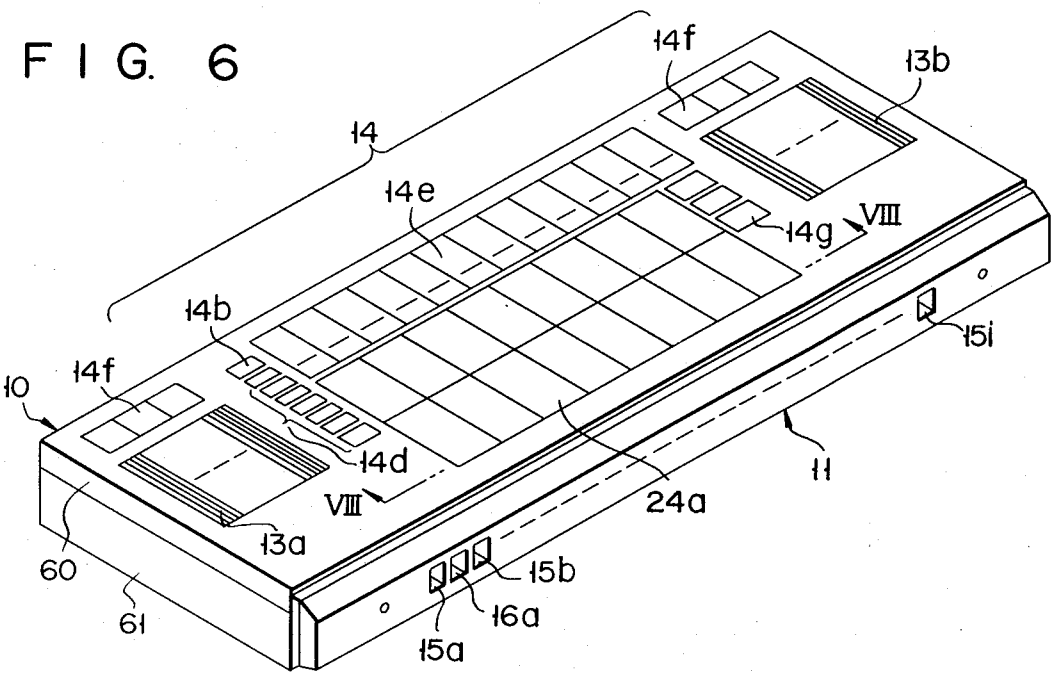
FIG. 6 is a perspective view showing an outline of an electronic musical instrument according to still another embodiment of the invention.

FIG. 6 shows an outline of an electronic harmonica according to still another embodiment of the invention. In the description to follow, like reference numerals are used to designate like portions as shown in FIG. 1, and description of those portions will be omitted herein. In FIG. 6, a solar cell 24*a* is used in addition to the batteries 24 of FIG. 3. The solar cell 24*a* constitutes one of the power sources of the electronic harmonica, and is provided on the top of the case 10. The control switch section 14 is further provided with chord type designating switch portions 14*f* and an effect switch portion 14*g*. Here, the chord designating switch portion 14*e* designates the roots of various chords, the switch portions 14*f* are used for designating the types of chords, and the switch portion 14*g* designates the kinds of effects such as tremolos.

Figure 7A:
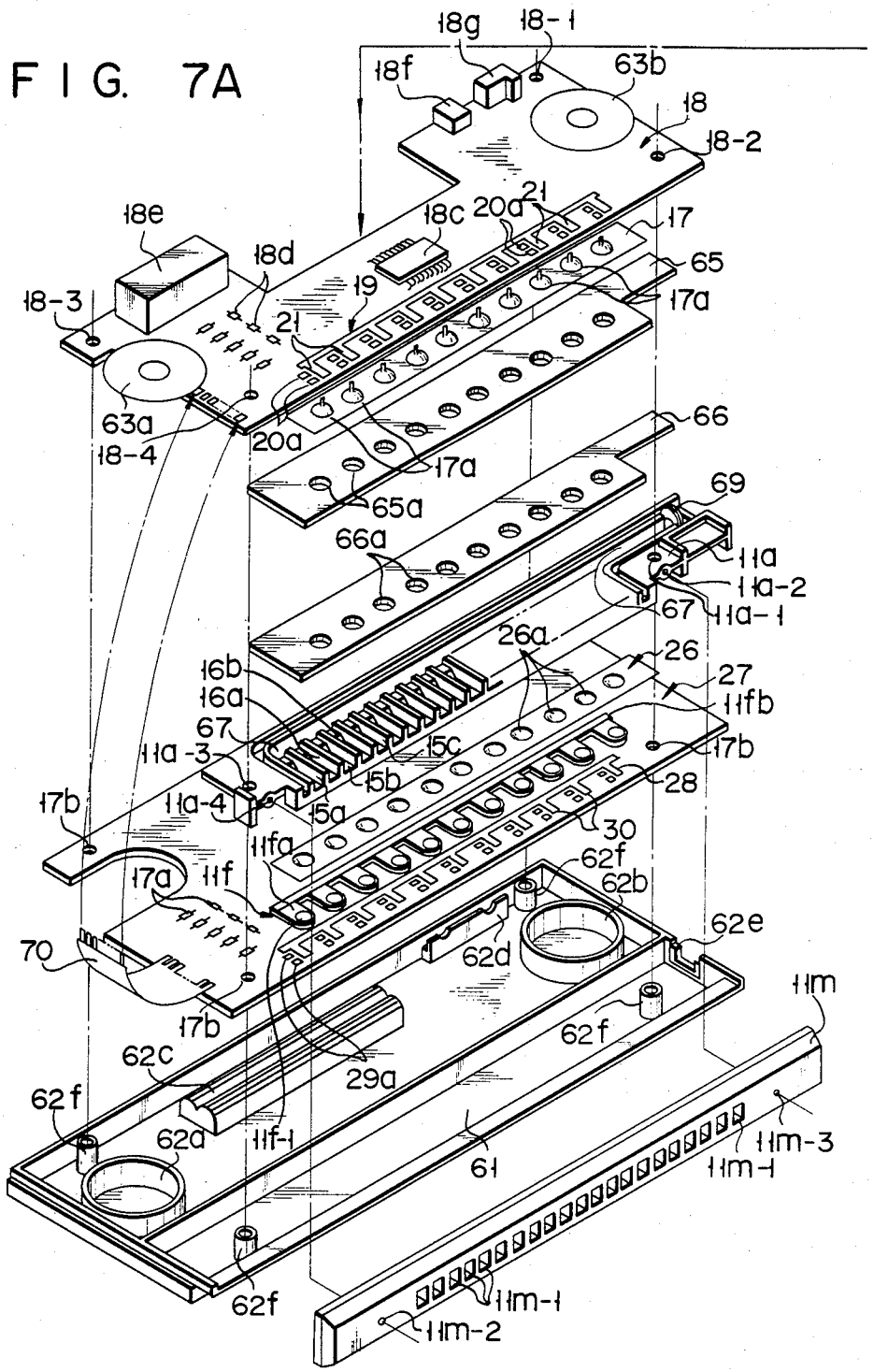
FIGS. 7A and 7B are disassembled perspective views of the instrument shown in FIG. 6.
Figure 7B:
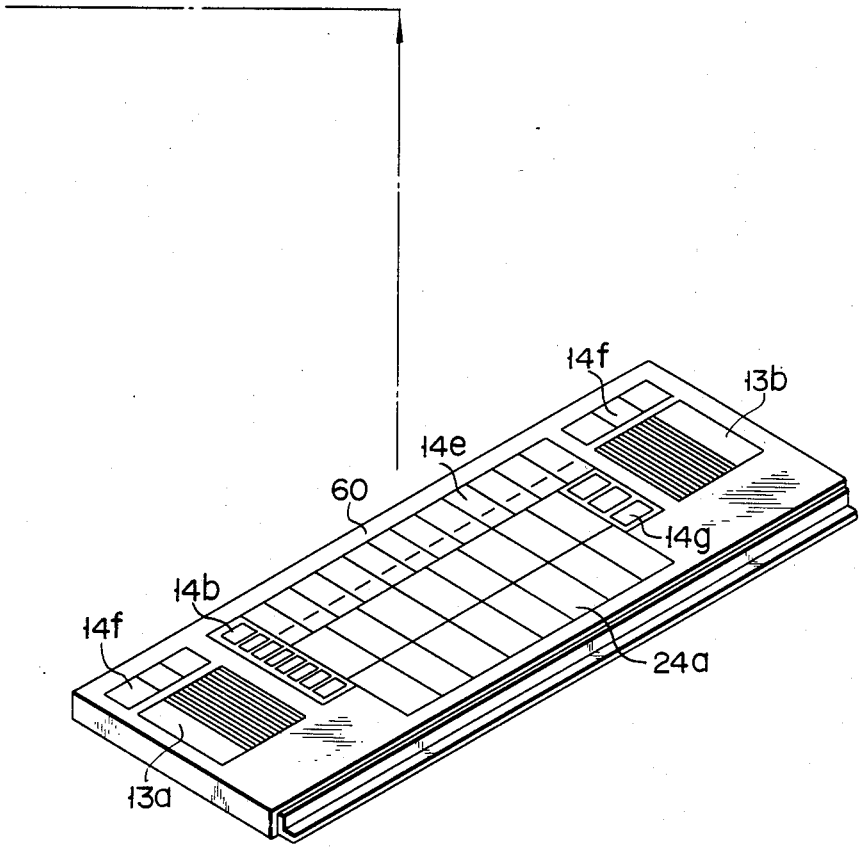

FIGS. 7A and 7B are disassembled perspective views of the above-mentioned electronic harmonica. The harmonica case 10 is formed of an upper case 60 and a lower case 61. The upper case 60 is provided with the solar cell 24*a* in the center of the top surface thereof, the loudspeaker sections 13*a* and 13*b* on both sides, and the individual switch portions 14*b*, 14*e*, 14*f* and 14*g*. Speaker holders 62*a* and 62*b*, a battery holder 62*c*, a jack retainer 62*d*, an air vent 62*e*, and screw bosses 62*f* are formed on the inside of the lower case 61. The speaker holders 62*a* and 62*b* serve to contain loudspeakers 63*a* and 63*b*, respectively, mentioned later. The battery holder 62*c* is used for holding batteries (not shown) as another power source. The jack retainer 62*d* holds down jacks (not shown) for external power source and earphone which are to be inserted in the instrument. The air vent 62*e* allows air to flow into and out from the harmonica housing 10*a*. The screw bosses 62*f* are used when the upper and lower cases 60 and 61 are coupled by means of screws (not shown). A mouthpiece 11*m* of the sound hole section 11 is attached to the front of the harmonica housing 10*a* defined between the upper and lower cases 60 and 61. The mouthpiece 11*m* is in the form of an elongate box. Openings 11*m*-1 are formed in the mouthpiece 11*m* corresponding to the inhalation holes 15*a*, 15*b*, . . . and exhalation holes 16*a*, 16*b*, . . . , and screw holes 11*m*-2 and 11*m*-3 are formed on both sides, individually.

An LSI 18*c*, chip elements 18*d* such as resistors, a transmitter 18*e*, an external power source connector 18*f*, and an earphone connector 18*g* are mounted on the top of the upper circuit board 18. Besides, the loudspeakers 63*a* and 63*b* formed of piezoelectric elements are mounted on both sides of the circuit board 18, and the contact mechanism 19 is provided on the front side (mouthpiece 11*m* side) of the circuit board 18. In this case, the external power source connector 18*f* and the earphone connector 18*g* correspond to the jack retainer 62*d* on the lower case 61. The loudspeakers 63*a* and 63*b* for producing musical sounds are located under the speaker sections 13*a* and 13*b* of the upper case 60, respectively. The contact mechanism 19 is formed of several pairs of fixed contacts 20*a* corresponding to the inhalation holes 15*a*, 15*b*, . . . among the inhalation and exhalation holes 15*a*, 15*b*, . . . and 16*a*, 16*b*, . . . , and movable contacts 21 capable of separably touching their corresponding pairs of fixed contacts 20*a*. The movable contacts 21 constitute the tooth portion of the contact mechanism 19 which is formed of a comb-shaped conductive film. The movable contacts 21 extend diagonally over their corresponding fixed contacts 20*a*.

A spacer 65 and a packing 66 corresponding to the top plate 11*d* of FIG. 2 are arranged under the upper elastic member 17. Through holes 65*a* and 66*a* are formed in the spacer 65 and the packing 66, respectively, corresponding to the individual bulging portions 17*a*.

The frame 11*a* of the sound hole section 11 is a plate-like member formed of synthetic resin, and is provided with the inhalation holes 15*a*, 15*b*, . . . and the exhalation holes 16*a*, 16*b*, . . . that are alternately arranged corresponding to the individual openings 11*m*-1 of the mouthpiece 11*m*. A communication passage 67 is formed at the back of the holes 15*a*, 15*b*, . . . and 16*a*, 16*b*, . . . The communication passage 67 communicates with both the inhalation and exhalation holes 15*a*, 15*b*, . . . and 16*a*, 16*b*, . . . , and extends to the right end portion of the frame 11*a* to correspond to the air vent 62*e* of the lower case 61, thus communicating with the outside. A pressure sensor 69 is provided near that portion of the communication passage 67 which corresponds to the air vent 62*e*. The pressure sensor 69 detects the pressure (flow quantity) of air flowing through the communication passage 67 in accordance with exhalation and inhalation, and converts the detected value into an electric signal for the control of the sound volume. The pressure sensor 69 is formed of a magnet and a coil. The magnet is shifted in accordance with the flow of air in the communication passage 67, and the sound volume is controlled on the basis of the electromotive force of the coil which is produced in accordance with the displacement of the magnet. Screw holes 11*a*-1, 11*a*-2, 11*a*-3 and 11*a*-4 are formed in both end portions of the frame 11*a*.

The spacer 11*f* is provided under the lower elastic member 26. The spacer 11*f* is formed of spacer pieces 11*fa* individually having through holes 11*f*-1 corresponding to the bulging portions 26*a*, and a coupling member 11*fd* coupling the spacer pieces 11*fa*.

The lower contact mechanism 28 is mounted on the lower circuit board 27, facing the spacer 11*f*. Like the upper contact mechanism 19, the lower contact mechanism 28 is formed of several pairs of fixed contacts 29*a* corresponding to the bulging portions 26*a* of the lower elastic member 26, and the movable contacts 30 capable of separably touching their corresponding pairs of fixed contacts 29*a* in accordance with elastic deformation of the bulging portions 26*a*. Like the movable contacts 21, the movable contacts 30 constitute the tooth portion of the contact mechanism 28 which is formed of a comb-shaped conductive film. The movable contacts 30 extend over their corresponding fixed contacts 29*a*. Chip elements 27*a*, such as resistors, are provided on the top of the lower circuit board 27. The lower circuit board 27 is connected to the upper circuit board 18 by means of a heat seal 70.

Thus, the upper circuit board 18, upper elastic member 17, spacer 67, packing 66, frame 11*a*, lower elastic member 26, spacer 11*f*, and lower circuit board 27 are arranged in descending layers in the lower case 61, and the upper case 60 is put on the lower case 61 and attached to the structure therein by means of screws (not shown). These screws are inserted from under the lower case 61 to pass through the screw bosses 62*f*, screw holes 17*b* formed in the lower circuit board 27, the screw holes 11*a*-1 and 11*a*-3 in the frame 11*a*, and screw holes 18-1, 18-2, 18-3 and 18-4 formed in the upper circuit board 18, and are then screwed into the underside of the upper case 60. The mouthpiece 11*m* is held in the front of the frame 11*a* of the sound hole section 11 between the upper and lower cases 60 and 61, and is attached to the frame 11*a* by fitting screws (not shown) into the screw holes 11*a*-4 and 11*a*-2 in the frame 11*a* via the screw holes 11*m*-2 and 11*m*-3 on both sides of the mouthpiece 11*m*.

The top side of the inhalation and exhalation sound holes 15*a*, 15*b*, . . . and 16*a*, 16*b*, . . . is closed by arranging the packing 66, spacer 65 upper elastic member 17, and upper circuit board 18, and then holding down these members by means of ribs 60*a* of the upper case 60. The bottom side of the frame 11*a* is closed by the bottom plate 11*c*, in which openings 16*a*-1, 16*b*-1, . . . are formed corresponding to the exhalation holes 16*a*, 16*b*, . . . The openings 16*a*-1, 16*b*-1, . . . are closed by the lower elastic member 26 under the frame 11*a*, and the bulging portions 26*a* of the lower elastic member 26 are fitted individually in the openings 16*a*-1, 16*b*-1, . . . The lower elastic member 26 is held down by the lower case 61 through the medium of the spacer 11*f* and the lower circuit board 27.

FIG. 9 is a sectional view taken along line IX—IX of FIG. 8, showing the internal structure of the inhalation hole 15*c* of the electronic harmonica described above. Referring now to FIG. 9, the operation of the inhalation hole 15*c* will be described. First, the mouthpiece 11*m* is held against the mouth of the player, and air is inhaled through the specified opening 11*m*-1. Thereupon, the outside air flows into the inhalation hole 15*c* through the communication passage 67 at the back of the hole 15*c*. As the air flows into the inhalation hole 15*c* in this manner, the air pressure inside the hole 15*c* is lowered. Then, the lowered air pressure acts on the bulging portion 17*a* of the upper elastic member 17 through the respective through holes 66*a* and 65*a* of the packing 66 and the spacer 65. As a result, the bulging portion 17*a* is depressed downward to pull down the movable contact 21 of the upper contact mechanism 19, so that the movable contact 21 touches the pair of fixed contacts 20*a* on the upper circuit board 18 to connect the fixed contacts 20*a*. If a breath is given out into the inhalation hole 15*c*, the movable contact 21 will move farther away from the fixed contacts 20*a*, so that the fixed contacts 20*a* will never be caused to contact with the movable contact 21.

Referring now to FIG. 10, the operation of the exhalation hole 16*b* will be described. First, the mouthpiece 11*m* is held against the mouth, and breath is given out into the specified opening 11*m*-1. Thus, air is introduced into the exhalation hole 16*b*, so that the air pressure inside the hole 16*b* is increased. Then, the increased air pressure acts on the bulging portion 26*a* of the lower elastic member 26 through the opening 16*b*-1. As a result, the bulging portion 26*a* is depressed downward so that the projection 26*b* on the bulging portion 26*a* presses down the movable contact 30 of the lower contact mechanism 28. Thereupon, the movable contact 30 touches the pair of fixed contacts 29*a* on the lower circuit board 27 to connect the fixed contacts 29*a*. In this case, the air fed into the exhalation hole 16*b* is discharged from the harmonica case 10 through the communication passage 67. If air is inhaled through the exhalation hole 16*b*, the movable contact 30 will move farther away from the fixed contacts 29*a*, so that the fixed contacts 29*a* will never be caused to conduct an input signal.

If the player exhales or inhales with his mouth on any of the exhalation and inhalation holes 16*a*, 16*b*, . . . and 15*a*, 15*b*, . . . , then air will flow through the communication passage 67. Thereupon, the pressure sensor 69 in the communication passage 67 detects an air pressure corresponding to the airflow, and delivers an electric signal representing the detected value.

Figure 11:
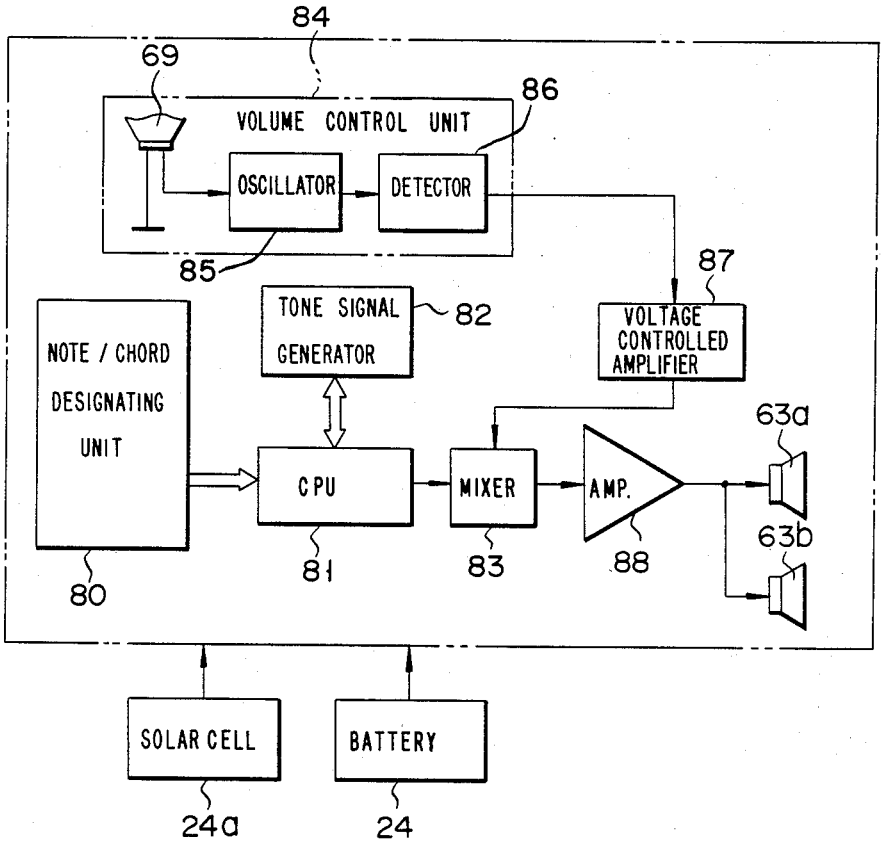
FIG. 11 is a block diagram of an electric circuit of the electronic harmonica shown in FIG. 6.

FIG. 11 is a block diagram showing a circuit arrangement of the electronic harmonica described with reference to FIG. 6. In FIG. 11, a note/chord designating unit 80 is shown. The note/chord designating unit 80 supplies a CPU (central processing unit) 81 with note information designated at the sound hole section 11, and chords, tones and other information designated by switching operation at the switch section 14. In this case, the note data is obtained if air is caused to flow through any of the exhalation and inhalation holes 16*a*, 16*b*, . . . and 15*a* 15*b*, . . . by exhalation and/or inhalation, and if the fixed contacts 20*a* or 29*a* of the contact mechanism 19 or 28 corresponding to the hole through which the air flows are caused to conduct.

The CPU 81 serves to control the whole circuit of the electronic harmonica. Data is transferred between the CPU 81 and a tone signal generator 82 in accordance with notes, chords and other data supplied from the note/chord designating unit 80. Namely, the tone signal generator 82 produces musical tone signals in accordance with the data from the note/chord designating unit 80, and supplies tone signals to the CPU 81. The tone signals are delivered from the CPU 81 to a mixer 83.

A volume control unit 84 includes the pressure sensor 69, an oscillator 85, and a detector 86. The pressure sensor 69 detects the pressure of air flowing through the communication passage 67 in response to exhalation or inhalation at the sound hole section 11. An electric signal corresponding to the detected air pressure is applied to the oscillator 85, which oscillates a waveform signal corresponding to the input signal. The detector 86 detects the oscillated waveform signal. The detection signal is supplied to a voltage-controlled amplifier 87. The amplifier 87 amplifies the detection signal and supplies it as a volume control signal to the mixer 83.

When supplied with the tone signal from the CPU 81 and the volume control signal from the voltage-controlled amplifier 83, the mixer 87 mixes these signals and delivers a mixed signal to an amplifier 88. The amplifier 88 amplifies the mixed signal, and a musical sound is delivered from the loudspeakers 63*a* and 63*b*.

All these components are supplied with source voltage from the built-in batteries 24 or the solar cell 24*a*.

According to the electronic harmonica described above, the harmonica case 10 contains therein the frame 11*a* of the sound hole section 11 formed of the alternately arranged exhalation and inhalation holes 16*a*, 16*b*, . . . and 15*a*, 15*b*, . . . , the conversion means (elastic members 17 and 26 and contact mechanisms 19 and 28) for converting the flows of air in the sound holes into electric signals, and the musical sound producing means (circuit boards 18 and 27 and loudspeakers 63*a* and 63*b*) for producing musical sounds in accordance with the electric signal from the conversion means. The case 10 is also provided with the power sources (solar cell 24*a* and batteries in the battery holder 62*c*) for those means. Thus, the electronic harmonica of this embodiment is improved in compactness and portability, and can afford satisfactory performance without the use of any external equipment. The above electronic harmonica is expressly provided with the volume control unit 84 which is formed of the pressure sensor 69 in the communication passage 67 of the frame 11*a* and other elements. Therefore, the sound volume can be controlled in accordance with the flow of air caused by exhalation and inhalation, ensuring more satisfactory performance. The conversion means is composed of the elastic members 17 and 26 which are elastically deformed in accordance with the flows of air in the exhalation and inhalation holes 16*a*, 16*b*, . . . and 16*a*, 16*b*, . . . , and the contact mechanisms 19 and 28 constructed so that electric signals are produced by bringing the movable contacts 21 and 30 into touch with the fixed contacts 20*a* and 29*a* in accordance with the elastic deformation of the elastic members 17 and 26. Thus, the above-mentioned electronic harmonica is simple in construction, highly compact and can be reduced in thickness. Moreover, it is suited for an open-air performance since it is provided with the solar cell 24*a* on the top of the case 10.

According to the electronic musical instrument of the present invention, as described above, a number of sound holes, conversion means for converting the flows of air in the sound holes into electric signals, and musical sound producing means for producing musical sounds in accordance with the electric signals from the conversion means, as well as power sources for those means, are incorporated in an instrument case. Thus, the instrument of the invention is improved in compactness and portability, and can afford satisfactory performance without the use of any external equipment.

What is claimed is:

1. An electronic musical instrument, comprising:

a case;

a plurality of sound holes arranged in the case;

openings formed individually in the walls of the sound holes;

elastic members of an elastic material closing the openings and adapted to be deformed in accordance with the change of the pressure inside the sound holes caused by exhalation or inhalation;

contact mechanisms disposed outside the sound holes and having contacts operatively coupled to the elastic members and adapted to be driven in accordance with the deformation of the elastic members;

input signal generating means connected to the contact mechanisms for generating input signals in accordance with the drive of the contacts;

musical sound producing means contained in the case for producing musical sounds in accordance with the input signals;

a power source in the case for supplying electric power to at least said musical sound producing means; and volume control means for collecting air flowing through said plurality of sound holes in one communicating passage formed in said case, and for controlling the volume of the musical sounds in accordance with the flow quantity of the collected air through said communicating passage.

2. The instrument according to claim 1, wherein said sound holes include exhalation holes and inhalation holes arranged alternately.

3. The instrument according to claim 1, wherein each said elastic member is a rubber plate having a bulging portion corresponding to each said opening and a projection protruding from the central part of the bulging portion.

4. The instrument according to claim 3, wherein said projection has a cut, and each said contact mechanism includes a fixed contact fixed on a circuit board, a movable contact formed corresponding to the fixed contact and having a movable end inserted in the cut on the projection, and means for connecting the fixed and movable contacts with the input signal generating means.

5. The instrument according to claim 1, wherein each said sound hole has an elongate channel communicating with the outside of the case.

6. The instrument according to claim 1, wherein each said contact mechanism is covered with a covering member outside the sound holes for isolating the contact mechanism from exhalation and inhalation.

7. The instrument according to claim 3, wherein said projection projects for substantially equal lengths from the outer and inner side faces of the bulging portion.

8. The instrument according to claim 2, wherein the openings in said inhalation holes are formed in a top plate covering the inhalation holes, and the openings in said exhalation holes are formed in a bottom plate covering the exhalation holes.

9. The instrument according to claim 8, wherein the elastic member corresponding to the opening of each said inhalation hole is a rubber plate having a bulging portion projecting upward on the outside of the opening of the inhalation hole and an upward projection integrally formed on the central part of the bulging portion.

10. The instrument according to claim 8, wherein the elastic member corresponding to the opening of each said exhalation hole is a rubber plate having a bulging portion projecting downward on the outside of the opening of the exhalation hole and a downward projection integrally formed on the central part of the bulging portion.

11. The instrument according to claim 1, wherein said power source includes a solar cell on the top of the case.

12. The instrument according to claim 1, wherein said musical sound producing means includes a musical signal generating circuit for generating musical sound signals in accordance with the input signals from the input signal generating means, and a speaker for producing the musical sounds in accordance with the musical sound signals from the musical sound signal generating circuit.

13. The instrument according to claim 1, wherein said volume control means includes a pressure sensor for detecting the pressure of air flowing through said communicating passage to deliver an output corresponding to the detected pressure, to control the volume of the musical sounds according to said delivered output.

* * * * *

UNITED STATES PATENT AND TRADEMARK OFFICE

CERTIFICATE OF CORRECTION

PATENT NO. : 4,566,363

DATED : January 28, 1986

INVENTOR(S) : Yoneaki ARAI

It is certified that error appears in the above-identified patent and that said Letters Patent is hereby corrected as shown below:

Column 9, line 49, change "...amplifier 83, the mixer 87.." to --...amplifier 87, the mixer 83...--.

Signed and Sealed this

Twenty-first Day of October, 1986

[SEAL]

*Attest:*

DONALD J. QUIGG

*Attesting Officer*

*Commissioner of Patents and Trademarks*